US006926760B2

(12) United States Patent
Miebach

(10) Patent No.: US 6,926,760 B2
(45) Date of Patent: Aug. 9, 2005

(54) METHOD FOR CLEANING A PARTICULAR FILTER

(75) Inventor: Rolf Miebach, Brühl (DE)

(73) Assignee: Deutz Aktiengesellschaft, Cologne (DE)

( * ) Notice: Subject to any disclaimer, the term of this patent is extended or adjusted under 35 U.S.C. 154(b) by 169 days.

(21) Appl. No.: 10/415,301

(22) PCT Filed: Nov. 6, 2001

(86) PCT No.: PCT/EP01/12801

§ 371 (c)(1),
(2), (4) Date: Apr. 28, 2003

(87) PCT Pub. No.: WO02/38921

PCT Pub. Date: May 16, 2002

(65) Prior Publication Data

US 2004/0020193 A1 Feb. 5, 2004

(30) Foreign Application Priority Data

Nov. 7, 2000 (DE) ..... 100 55 210

(51) Int. Cl.[7] ..... B01D 46/00

(52) U.S. Cl. ..... 95/279; 95/278; 95/280; 95/281; 96/233; 55/301; 55/302; 55/385.3; 55/421; 55/428; 55/495; 55/523; 55/DIG. 30; 60/311

(58) Field of Search ..... 95/278, 279, 280, 95/281; 96/233; 55/282.2, 282.3, 301, 302, 303, 304, 385.3, 421, 428, 490, 495, 523, DIG. 10, DIG. 30; 60/311

(56) References Cited

U.S. PATENT DOCUMENTS

| | | | | | |
|---|---|---|---|---|---|
| 3,242,652 | A | * | 3/1966 | Malenchini | 96/233 |
| 4,731,100 | A | * | 3/1988 | Loeffelmann et al. | 95/281 |
| 5,229,078 | A | * | 7/1993 | Haerle | 55/DIG. 30 |
| 6,149,716 | A | * | 11/2000 | Bach et al. | 95/280 |
| 6,602,328 | B2 | * | 8/2003 | Doi et al. | 95/278 |
| 6,755,016 | B2 | * | 6/2004 | Dittler et al. | 55/302 |
| 2004/0103788 | A1 | * | 6/2004 | Streichsbier et al. | 95/279 |
| 2004/0128964 | A1 | * | 7/2004 | Cheng | 55/523 |
| 2004/0200198 | A1 | * | 10/2004 | Inoue et al. | 55/282.3 |

FOREIGN PATENT DOCUMENTS

| | | | | |
|---|---|---|---|---|
| DE | 43 13 132 | | 10/1994 | |
| EP | 0 019 635 | | 10/1980 | |
| EP | 0 433 028 | A1 * | 6/1991 | B01D/24/22 |
| EP | 1 060 780 | | 12/2000 | |
| EP | 1 336 729 | A1 * | 8/2003 | B01D/41/04 |
| JP | 61-192805 | | 8/1986 | |

* cited by examiner

*Primary Examiner*—Duane Smith
*Assistant Examiner*—Jason M. Greene
(74) *Attorney, Agent, or Firm*—Charles L. Schwab; Nexsen Pruet, LLC

(57) ABSTRACT

The invention relates to a method of cleaning a particle filter (1) by means use of a fluid, whereby the filter material is alternately treated with pressure and high flow rate. By means of the above using this method, the ash is washed out of the filter material, essentially more effectively; namely, and more completely and more gently for the filter material (2) than previously possible.

27 Claims, 1 Drawing Sheet

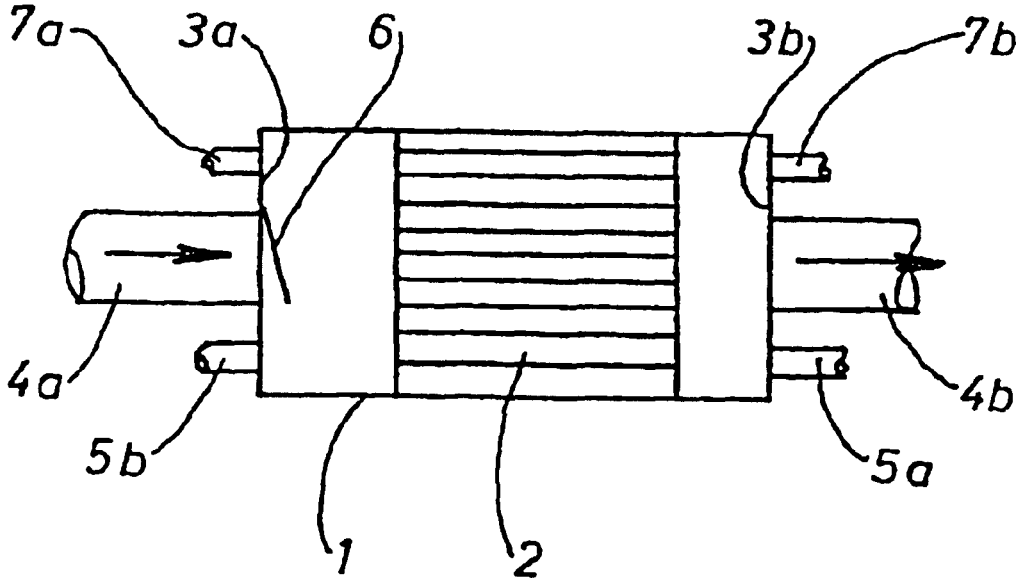
7a
3a
6
3b
7b
4a
5b
1
2
4b
5a

METHOD FOR CLEANING A PARTICULAR FILTER

TECHNICAL FIELD

This invention relates to a method for cleaning a particle filter in the exhaust system of an internal combustion engine, in particular an auto-ignition internal combustion engine. The particle filter has a filter housing having a filter material through which the exhaust can flow, soot particles and ashes separated from the exhaust adhering to the filter material, and the ashes arising being flushable as necessary by a fluid conveyable through the filter material.

BACKGROUND OF THE INVENTION

German patent number 43 13 132 issued Oct. 27, 1994 to Reinhard Baumgartner et al. discloses a particle filter in the exhaust system of a diesel engine which is cleaned by burning the soot particles adhering to the filter material and then rinsing the filter material with a liquid, which is in particular an aqueous solvent with additives. Rinsing is effected countercurrent to the exhaust stream. The aqueous solution is either delivered continuously by a pump or drawn from a liquid reservoir lying geodetically higher than the particle filter. Cleaning is effected by first completely flooding the filter material by closing the drain for the aqueous solution, then waiting until the ash has dissolved out of the filter material, and finally opening the drain and allowing the aqueous solution together with the dissolved ash to be removed from the filter material. The filter material can be dried with compressed air afterward.

SUMMARY OF THE INVENTION

It is an object of the invention to provide a method for efficiently cleaning inorganic residues from a particle filter which method is not time consuming and is easy to use.

The foregoing object is achieved by flushing the filter material acted upon by turns with pressure and high flow velocity. By this method the ashes and also at least partially the soot particles are flushed from the filter material in a manner that is much more effective, that is, more rapid, complete and gentle to the filter material than was formerly possible. The method is effective regardless of the derivation of the ashes. They may have arisen by chemical reactions of substances stored in the filter material or they may have been formed inside the internal combustion engine by reactions of substances contained in the fuel and in the lubricating oil. In one embodiment of the invention, the filter material is acted upon by a two-phase flow of the fluid, that is, the fluid is conveyed through the filter material in its liquid phase and its gas phase. Since, as will be discussed later, the liquid is already heated to a temperature in the range of the boiling point, the institution of gas and of liquid phases imposes no substantial expenditure. The gas phase can be instituted in the following manner. After the liquid is heated to a temperature in the range of the boiling point, part of the liquid is withdrawn and converted into its vapor or gas state, for example in a separate vessel or part of a vessel. In a second embodiment of the invention, a gas and the liquid flow through the filter material alternately. In another embodiment of the invention, water vapor, air or exhaust of the internal combustion engine, which is running during the cleaning operation, is advantageously used as gas. Naturally, other gases can also be employed, but the gases concretely named above have proven suitable because of their availability. Both method variations are consequently easy to apply, and the particle filter need not be removed from the exhaust tract.

Tap water from a city or company water system may be used as the fluid. Detergents and in particular environmentally compatible substances are admixed with the tap water as necessary. This can be effected by generating a mixture in an accompanying feed vessel or by metered addition to the tap water being conveyed through the filter material.

The temperature of the fluid applied to the filter material is adjusted to approximately 60 to 100° C. The temperature is adjusted in particular in dependence on the instantaneous temperature in the filter material. If, for example, the temperature in the filter material before, or at the beginning, of the cleaning operation is higher than 100° C., the fluid is admitted at a low temperature (for example 60° C.) in order to cool the filter material. If the filter material has a temperature of less than 100° C. at the beginning of the cleaning operation, the fluid can be admitted into the filter material in vapor form in order to generate the liquid phase favorable for the cleaning operation through condensation inside the filter material.

The fluctuations of pressure and flow velocity are generated by pulsation of the gas and/or by pulsating admission of the liquid. This can be effected, for example, through actuation of valves in the supply line or lines or through control of the pumps or compressors to generate pulse surges in flow.

The liquid and/or the gas is conveyed through the filter material countercurrent to the exhaust stream. Although this is the preferred embodiment, a cocurrent direction of flow is also possible.

The backwashed soot particles together with the cleaning agents can escape through a cleaning opening upstream of the particle filter. The internal combustion engine may be in service during this cleaning operation, and the exhaust of the internal combustion engine is able to escape through the cleaning opening upstream of the particle filter. This embodiment is preferably performed during a shop cleaning operation in the built-in state. Thus the water or ash sludge is prevented from reaching the internal combustion engine or sensitive sensors in the exhaust system. It is also conceivable to employ the exhaust as the gaseous substance of the cleaning combination in this process.

The flushed ash may be separated from the liquid and collected in a downstream separator, for example in a liquid separator. The liquid is thus available at least for further flushing operations, while the ash is removed from the liquid separator and forwarded to disposal.

Depending on the service of the internal combustion engine and the size of the particle filter or of the cleaning device, the cleaning can be effected during a shop visit or during normal operation or onsite during a shut down of the internal combustion engine.

BRIEF DESCRIPTION OF THE DRAWINGS

Further advantageous embodiments of the invention can be inferred from the embodiment shown in accompanying single drawing FIGURE.

DETAILED DESCRIPTION OF THE INVENTION

The single FIGURE shows a particle filter housing 1 into which filter material 2 is inserted. The filter housing 1 is formed in the shape of a circular cylinder and has annular end pieces 3*a*, 3*b*. Connected to openings in these end pieces 3*a*, 3*b* is an exhaust inlet pipe 4*a* and an exhaust outlet pipe 4*b*. The exhaust inlet pipe 4*a* is connected to the internal combustion engine in a suitable fashion, while exhaust outlet pipe 4*b* opens into the environment. Noise suppressors and/or cleaning devices or exhaust bypasses or exhaust short-circuit pipes can be inserted into the exhaust inlet pipe 4*a* and the exhaust outlet pipe 4*b*.

During the operation of the internal combustion engine, soot particles and ashes are filtered out of the exhaust by the filter material 1. These particles are made up, for the most part, of soot and organic residues. A variety of methods (so-called regeneration methods) are available for the continous or discontinuous elimination of these substances from particle filters, these methods being performed in time-dependent or operation-dependent fashion. For example, the particles built up in filter material 2 can be converted at least largely to ashes by combustion or chemical processes. The particles emitted from internal combustion engines also, however, contain inorganic constituents, chiefly oxidation products of organometallic additives to lubricating oil and to fuel, as well as wear products. These substances (ashes) cannot be eliminated by conventional methods. These ashes are removed by the flushing of the filter material 2. For this purpose at least one fluid flows through the filter material, the fluid being conveyed through the filter material 2 under pulsating pressure and/or flow rate. For this purpose at least two additional ports 5*a*, 5*b* are provided in the end pieces 3*a*, 3*b*, through which ports the liquid is conveyed into the filter housing 1 and discharged therefrom. The fluid is conveyed in its liquid state or its gas state through filter housing 1 countercurrent to the exhaust stream or with the exhaust stream. A check valve 6 can be inserted into the vehicle exhaust inlet pipe 4*a*, which check valve closes automatically or by manual actuation.

Additional ports 7*a*, 7*b* can be provided in the end pieces 3*a*, 3*b*, through which the fluid is conveyed in a different phase state. It is also provided, however, to convey the fluid, in a different phase state from that in the first phase state, in and out by way of the ports 5*a*, 5*b*. The fluid is normally water with which detergents are admixed as appropriate. The temperature of the fluid applied to the filter material 2 is preferably between 60 and 100 degrees Celsius, with the temperature being controlled in dependence on the filter temperature.

What is claimed is:

1. A method for cleaning a particle filter in the exhaust system of an auto-ignition internal combustion engine, comprising the steps of:

providing a particle filter having a filter housing into which there is inserted filter material through which the exhaust of said engine flows and in which soot particles and ashes separated from said exhaust adhere to said filter material, flushing said ashes from said filter material by conveying the liquid phase and the gas phase of a fluid through said filter material with pressure and high flow velocity in turns.

2. The method of claim 1 wherein said engine is running during said cleaning and said gas is water vapor.

3. The method of claim 1 wherein said liquid is tapwater.

4. The method of claim 3 wherein detergents are admixed with said tap water.

5. The method of claim 1 wherein the temperature of said liquid delivered to said filter material is between 60° C. and 100° C.

6. The method of claim 5 wherein the temperature of said liquid is adjusted in dependence on the temperature of said filter material.

7. The method of claim 1 wherein fluctuations of pressure and flow velocity are generated by pulsations of said gas and pulsating admission of said liquid.

8. The method of claim 1 wherein said liquid and said gas are conveyed through said filter material countercurrent to said exhaust of said engine.

9. The method of claim 8 wherein the backwashed soot particles escape through a cleaning opening upstream of said particle filter.

10. The method of claim 9 wherein said internal combustion engine is in service during the cleaning operation and said exhaust of said internal combustion engine escapes through said cleaning opening upstream of said particle filter.

11. The method of claim 1 wherein said ash is separated from said liquid and collected by a downstream separator.

12. The method of claim 1 wherein said cleaning is effected during a shop visit.

13. The method of claim 1 wherein said cleaning is effected during normal service of the internal combustion engine under normal operating conditions.

14. A method for cleaning a particle filter in the exhaust system of an auto-ignition internal combustion engine, comprising the steps of:

providing a particle filter having a filter housing into which there is inserted filter material through which the exhaust of said engine flows and in which soot particles and ashes separated from the exhaust adhere to said filter material, and flushing said ashes from said filter material by alternating through-flow of a gas and a liquid with pressure and high flow velocity.

15. The method of claim 14 wherein said engine is running during said cleaning and said gas is the exhaust of said engine.

16. The method of claim 14 wherein said engine is running during said cleaning and said gas is water vapor.

17. The method of claim 14 wherein said liquid is tapwater.

18. The method of claim 17 wherein detergents are admixed with said tap water.

19. The method of claim 14 wherein the temperature of said liquid delivered to said filter material is between 60° C. and 100° C.

20. The method of claim 19 wherein the temperature of said liquid is adjusted in dependence on the temperature of said filter material.

21. The method of claim 14 wherein fluctuations of pressure and flow velocity are generated by pulsations of said gas and pulsating admission of said liquid.

22. The method of claim 14 wherein said liquid and said gas are conveyed through said filter material countercurrent to said exhaust of said engine.

23. The method of claim 22 wherein the backwashed soot particles escape through a cleaning opening upstream of said particle filter.

24. The method of claim 23 wherein said internal combustion engine is in service during the cleaning operation and said exhaust of said internal combustion engine escapes through said cleaning opening upstream of said particle filter.

25. The method of claim 14 wherein said ash is separated from said liquid and collected by a downstream separator.

26. The method of claim 14 wherein said cleaning is effected during a shop visit.

27. The method of claim 14 wherein said cleaning is effected during normal service of the internal combustion engine under normal operating conditions.

* * * * *